US005105525A

United States Patent [19]

Firatli et al.

[11] Patent Number: 5,105,525

[45] Date of Patent: Apr. 21, 1992

[54] PROCESS FOR MAKING A SMOOTHING IRON SOLEPLATE

[75] Inventors: Ahmet Firatli, Wiesbaden; Diethard Burger, Sant Just Desvern; Klaus Amsel, Oberursel; Bernd Lindstaedt, Dietzenbach, all of Fed. Rep. of Germany

[73] Assignee: Braun Aktiengesellschaft, Frankfurt, Fed. Rep. of Germany

[21] Appl. No.: 645,202

[22] Filed: Jan. 24, 1991

Related U.S. Application Data

[62] Division of Ser. No. 395,964, Aug. 18, 1989, Pat. No. 5,025,578.

[51] Int. Cl.[5] ..... B23P 17/00

[52] U.S. Cl. ..... 29/527.3; 219/254; 219/462; 427/34

[58] Field of Search ..... 29/527.3; 427/34; 219/254, 462, 464

[56] References Cited

U.S. PATENT DOCUMENTS 2,846,793 8/1958 Studer .
3,104,482 9/1963 Jepson .
3,412,492 11/1968 McCormick .
4,196,340 4/1980 Evans .
4,206,340 6/1980 Osrow .
4,665,637 5/1987 Kramer .
4,702,933 10/1987 Kramer ..... 427/34
4,862,609 9/1989 Ullrich .

FOREIGN PATENT DOCUMENTS 949727 9/1963 Fed. Rep. of Germany .
1952846 4/1971 Fed. Rep. of Germany .
60-150799 8/1985 Japan .

OTHER PUBLICATIONS

Part 2 of German DIN 1725, Aluminum Alloys Casting Alloys.

*Primary Examiner*—Carl J. Arbes
*Attorney, Agent, or Firm*—Fish & Richardson

[57] ABSTRACT

The invention is directed to a coated smoothing iron soleplate which is preferably composed of an aluminum alloy, its anticorrosive coating which is preferably a nickel hard alloy having an extremely scratch-resistant surface capable of sliding well and easy to clean. The coating is preferably applied by a high-speed flame spraying method, followed preferably by a grinding and polishing operation using a drag grinding method.

13 Claims, 1 Drawing Sheet

PROCESS FOR MAKING A SMOOTHING IRON SOLEPLATE

This is a division of application Ser. No. 07/395,964, filed Aug. 18, 1989 now U.S. Pat. No. 5,025,578 issued June 25, 1991.

This invention relates to a smoothing iron soleplate.

Smoothing iron soleplates of this type have been known for some time in a wide variety of embodiments. Thus, EP-A3 0 217 014 describes a soleplate in which the soleplate body is made of aluminum in order to obtain a high thermal conductivity and a reduced weight and consequently to improve the manipulability of the entire iron.

Because the strength of aluminum is lower than of other metals frequently used also for domestic applications as, for example, steel or iron, ironing over hard objects such as zippers or buttons may scratch the ironing surface, causing burrs protruding from the soleplate similar to a metal-cutting operation. When ironing particularly delicate textile fabrics such as silk, these burrs tend to pull threads from the fabric, thereby damaging it. However, such fabrics become damaged already when such a burr merely roughens the silky lustrousness of the textile surface.

To avoid these disadvantages, the ironing side of the soleplate described in EP-A3 0 217 014 is provided with a mechanically resistant ceramic layer applied by a thermal spraying operation, for example, flame or plasma spraying. The mechanically resistant layer thereby produced has the disadvantage of being porous and of absorbing, in particular in steam irons, humidity, air and also contaminants which may penetrate to the soleplate body. This produces corrosion on the aluminum surface on the ironing side of the soleplate body, tending to cause warpage or blistering and eventually even detachment of the mechanically resistant layer. In consequence, the ironing surface of the soleplate body is damaged, which may in turn damage the article being iron@d and results in increased frictional forces as the smoothing iron is being moved.

In addition, in continued use the smoothing iron soleplate known from EP-A3 0 217 014 is subject to a great deal of contamination by fabric finishing agents and starch built up on and burning into the mechanically resistant layer and also by textile particles when the heat setting is too high for these textiles. The result is a dull soleplate surface impairing the sliding motion over the article being ironed. Removing burnt-in fabric finishing agents by cleaning agents is practically impossible. The only way to restore the sliding ability of the soleplate is to grind it off on the ironing side and apply a new coating.

It is further known (cf. DE-AS-1 952 846 and DE-OS 21 51 858, for example) to coat the metallic ironing side with a layer of temperature-resistant plastic material as, for example, PTFE, which resists contamination and has particularly good sliding abilities. One of the methods suitable for this purpose is described in DE-OS 21 51 858. However, soleplates of this type are easily scratched when in continuous use or overheated, because the plastic material becomes locally worn down completely by the pressing action. Even if the plastic material is not yet worn down to the metallic surface, burrs may be formed of the plastic material which are sufficient to damage the article being ironed. The scratch resistance is further reduced in particular in soleplates made of aluminum, because the soleplate body itself has no sufficient hardness.

For this reason, the soleplate body of the smoothing iron soleplate known from DE-AS 19 52 846 is composed of steel sheet having an anticorrosive copper layer as first coating, an overlying nickel-chromium layer as second coating, and finally a layer of a temperature-resistant plastics material overlying the nickel-chromium layer as third coating. Prior to applying the temperature-resistant plastic layer, the surface of the nickel-chromium layer is sandblasted such that it is entirely hammered into the subjacent anticorrosive copper layer. It will be seen that four process steps are necessary for manufacturing the known coating—excluding a surface treatment of the steel sheet material prior to the application of the copper layer. Accordingly, the entire manufacturing process for the coating is relatively complex and too costly for mass production of soleplates. In addition, the scratch resistance of the soleplate is limited due to the insufficient hardness of the plastic layer, and its sliding ability is also reduced after abrasion of the plastic layer because of the prior roughening operation of the nickel-chromium layer by sandblasting.

Finally, it is known from DE-OS 36 44 211 to provide the ironing side of an aluminum soleplate first with a mechanically resistant layer of ceramic material and to subsequently seal this layer with an organic bonding agent, preferably PTFE. A coating for a smoothing iron soleplate is thereby obtained which is scratch resistant, easy to clean and prevents corrosion while its good sliding ability is maintained.

However, also this soleplate has the disadvantage that its manufacture requires a plurality of process steps and that a bond between the ceramic layer and the ironing side of the aluminum soleplate which continues to be secure also after prolonged use can only be achieved by the application of a metallic adhesive vehicle layer intermediate these two materials. Failing this the distinctly different coefficients of thermal expansion of aluminum and most of the ceramic materials cause the bond between the soleplate body and the mechanically resistant layer to be broken up at least in part after a period of some length, which may result in the ingress of humidity particularly in steam irons, causing corrosion and the attendant adverse effects on the ironing side of the soleplate body, as described in the foregoing.

It is a further disadvantage of this known smoothing iron soleplate that the PTFE coating wears down after prolonged use, causing the fabric to become stained by rubbed off PTFE. At the same time, the roughness peaks of the ceramic layer start to emerge, which reduces the sliding ability of the soleplate, may damage the fabric and enables particles of dirt to embed into the rougher soleplate surface. Finally, as a result of the poorer thermal conductivity of PTFE and ceramic material as against metals, the smoothing iron requires a longer heat-up time until it is ready for use, while on the other hand the heat transference from the soleplate body to an article absorbing a major quantity of heat during ironing is not sufficient enough to maintain the soleplate surface at the necessary temperature.

Therefore, it was an object of the present invention to devise a coating for a smoothing iron soleplate which—in addition to affording the known advantages of corrosion prevention, scratch resistance, good sliding ability and ease of cleaning—can be manufactured with a small number of process steps and which ensures a secure and complete bond between the coating and the soleplate body also after prolonged use.

The smoothing iron soleplate of the present invention has the advantage that it can be manufactured in only two steps including a thermal spraying operation and a grinding operation, while retaining its outstanding features referred to in the object of the invention.

Further, the coating features an excellent adherence to the soleplate body also on frequent heating and subsequent cooling of the soleplate body, because the coefficients of thermal expansion of two metallic bodies differ to a lesser degree than those of a metal on the one side and a ceramic material on the other side.

In addition, the thermal spraying method causes the density of the coating to be quite high and, accordingly, the porosity to be quite low, being of the order of 2% by volume. Further, the thermal conductivity of a metal is higher than the thermal conductivity of a ceramic material or a PTFE coating. Therefore, a smoothing iron having a soleplate as disclosed in the present invention heats up substantially more rapidly and is thus ready for use at an earlier moment than known smoothing irons. Also, the good thermal conductivity of the coating ensures the necessary heat transference from the soleplate body to the article being ironed even if the article absorbs major amounts of heat.

Moreover, the coating of the smoothing iron soleplate of the invention retains the feature of a polished and easy to clean surface for the useful life of the iron.

The grinding method of the invention has the advantage of eliminating the need for the soleplate body to have its ironing side planar within narrow limits, that is, the soleplate may be formed in concave, convex or wavy shape, another advantage being its relatively small amount of abrasion. In addition, not only the ironing side, but also the lateral edges of the soleplate body are ground in a single operation, so that the second operation required in conventional grinding methods may be omitted.

In the use of a soleplate body for a steam iron in which steam vents have to be provided on its ironing side, the drag grinding method applied is particularly advantageous because it eliminates the sharp edges otherwise occurring on the steam vents, the small dimensions of the abrasive particles enabling them to abrade material also in this area.

By dividing the grinding operation into two steps, it is possible to grind the coating of the smoothing iron soleplate relatively quickly and thus in a particularly economical manner down to a low residual roughness which is extremely advantageous for the gliding ability of the iron.

It has shown that a particularly good adhesion of the coating can be achieved if an aluminum alloy is chosen for the soleplate body, in particular with an alloying constituent of silicon or magnesium is used.

If a hard alloy having nickel, cobalt or chromium as a main constituent, advantageously a nickel alloy with a melting point of about 1,050° C. and a Rockwell hardness of up to about HRC 64, is selected for the material of the coating, a surface with a roughness average value $R_a$ of only about 3 to 5 pm, maximum can be obtained on the ironing side when using a hypersonic flame spraying method, whilst the surface roughness average value exceeds 5 μm significantly where other alloys are used.

In the use of a hypersonic high-speed flame spraying method with a comparatively low flame temperature in the range of about 2,500° C., a nickel alloy and a grain size of 20 to 60 μm result in a particularly good bond on the one hand and a low surface roughness of the applied coating on the other hand. By virtue of the last-mentioned advantage, relatively little complexity is involved by the second process step, that is, the grinding operation.

In order to further improve the adhesion of the coating, it has proved to be an advantage to roughen the ironing side of the soleplate body prior to the application of the coating by pressure blasting with a granular material until a surface is obtained having a roughness average value according to German Standard DIN 4768 of $R_a=2$ to 10 pm, approximately.

A coating with a thickness of between 50 μm and 200 μm has proved to be an optimum compromise between the advantages of a very thick coating (long life and optimum protection against corrosion) and the advantages of a coating of minimum possible thickness (material and energy savings in the thermal spraying process as well as minimum possible cycle times in series production.

An embodiment of the invention will be described in the following, reference being had to FIGS. 1 to 3 of the drawings in which.

Figure 1:
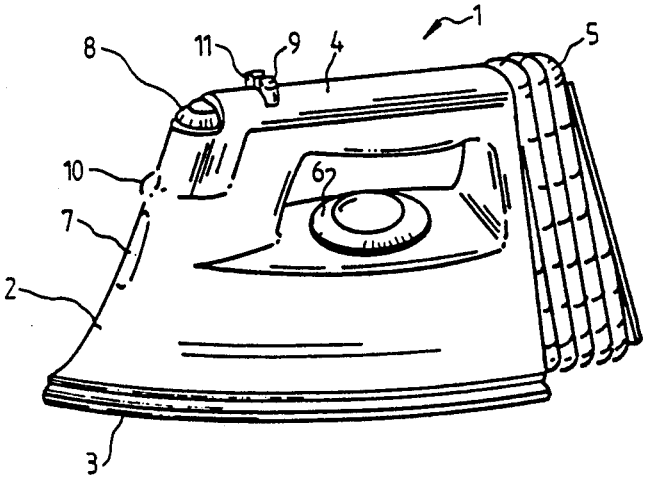
FIG. 1 is a perspective view of a smoothing iron with the soleplate constructed in accordance with the invention.

Referring to FIG. 1, there is shown a steam iron 1 that has a housing 2 with a soleplate structure 3 and a manipulating handle 4. Formed in the housing 2 is a water reservoir which is adapted to be filled and emptied through an opening 7. A heating element 19 (FIG. 3) in the housing 2 is in intimate thermal contact with the soleplate structure 3 and is adapted to be connected to the voltage source via a power supply cord 5. The temperature of the soleplate 3 is variable by a first rotary knob 6 connected to a temperature control device.

Figure 2:
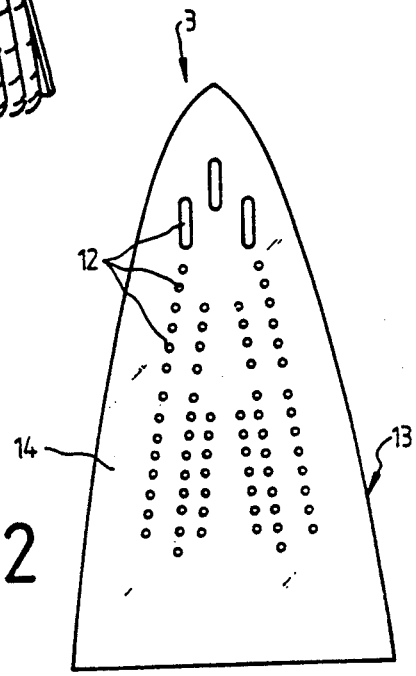
FIG. 2 is a plan view of the ironing side of the smoothing iron soleplate of FIG. 1 constructed in accordance with the invention.

Steam vents 12 of varying sizes are provided on the ironing side of the soleplate 3 (cf. FIG. 2). To control the quantity of steam discharged from the steam vents 12, the iron has a second rotary knob 8 for adjustment of the quantity of water admitted from the water reservoir to the evaporation chamber 15 per unit of time, and thus the quantity of water changeable to steam. On the upper side of the manipulating handle 4, the steam iron 1 has a first control button 9 and a second control button 11. By pressing down on the first control button 9, a spray of water is discharged from a spray nozzle 10 provided on the front of the steam iron 1 for dampening the article being ironed, while activation of the second control button 11 changes a major metered amount of water to steam within a short time, delivering an extra surge of steam from the steam vents 12.

Figure 3:
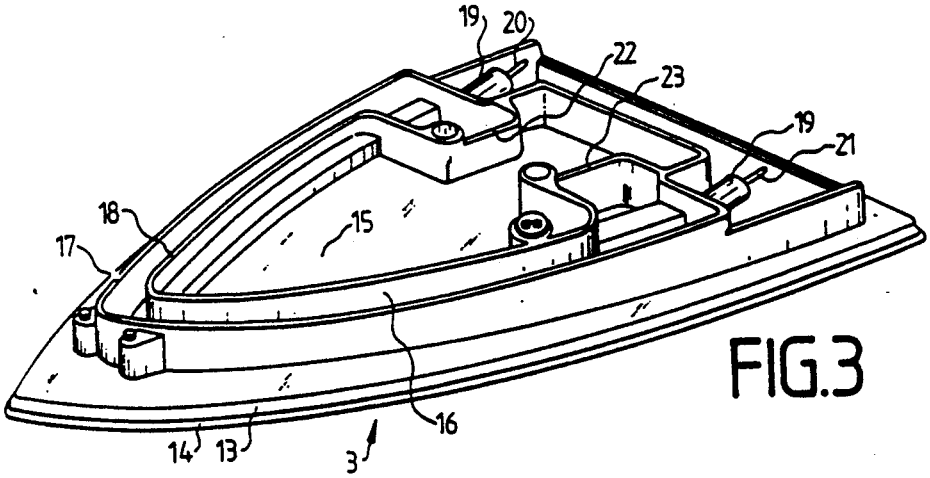
FIG. 3 is a perspective view of a soleplate of the invention separated from the smoothing iron, taken from an angle from above.

According to FIGS. 2 and 3, the ironing side of the soleplate structure 3 comprises substantially a soleplate body portion 13, a coating 14 and the vents 12. Provided on the side of the soleplate structure 3 remote from the ironing side are an evaporation chamber 15 which is adapted to be closed on its upper side by a cover not shown, and a steam distribution chamber 16 which in turn is in communication with the vents 12.

The steam distribution chamber 16 is substantially formed by a channel extending along the edge of the soleplate body portion 13, the channel being bounded in horizontal direction by partition walls 17 and 18, in downward direction by the soleplate body portion 13 itself, and in upward direction—as the evaporation chamber 15—by the cover not shown. Extending parallel to the steam distribution chamber 16 is a heating element 19 cast integral with the soleplate body portion 13, part of it projecting also into the evaporation chamber 15. At the heel end of the soleplate body portion 13, the heating element 19 has contact lugs 20 and 21 which are connected to the power supply via the temperature control device not shown in the drawing. In the rear area of the evaporation chamber 15, the partition wall 18 has two opposed passageways 22 and 23 establishing on both sides the connection of the evaporation chamber 15 with the steam distribution chamber 16 with the cover seated in place.

The soleplate body portion 13 is manufactured by the die-casting method and is made of an aluminum alloy, for example, one of the alloys GD-Al Si 10 Mg (9–11 percent silicon, 0.2–0.5 percent magnesium, 0.001–0.4 percent manganese, remainder aluminum), GD-Al Mg 9 (7–10 percent magnesium, 0.01–2.5 percent silicon, 0.2–0.5 percent manganese, remainder aluminum), GD-Al Si 12 (10.5–13.6 percent silicon, 0.001–0.4 percent manganese, remainder aluminum) or GD-Al Si 12(Cu) (10.5–13.5 percent silicon, 0.1–0.5 percent manganese, remainder aluminum) referred to in part 2 of German Industrial Standard DIN 1725. Subsequent to casting, the whole body is cleaned, and its ironing side is roughened by pressure blasting with a granular material. The grain size of the material is chosen such as to produce on the ironing side of the soleplate body portion 13 a surface with a roughness average value according to German Standard DIN 4768 of $R_a=2$ to 10 μm, approximately.

Following this operation, the ironing side of the soleplate body portion 13 is coated with a nickel hard alloy having a melting point of about 1,050° C. and a Rockwell hardness of up to about HRC 64. The coating 14 is applied by means of a thermal spraying method, as, for example, flame, plasma or arc spraying. Preferably, a hypersonic flame spraying method is used, that is, the individual particles of the nickel hard alloy are caused to impinge against the ironing side of the soleplate body portion 13 at ultrasonic speed. The flame temperature for liquefying the particles of nickel hard alloy whose grain size is in the range of 20 to 60 μm is about 2,500° C.

In detail, the hypersonic flame spraying method used and known per se incorporates the following essential features and parameters:

Propane and oxygen are supplied to the premixing chamber of a water-cooled high-speed burner. The mixture is ignited and delivered to a combustion chamber. The combustion chamber, in addition to receiving a carrier gas composed of nitrogen or air, is further charged with a nickel hard alloy having a melting point of about 1,050° C., a grain size of between 20 and 60 μm and a Rockwell hardness of up to about HRC 64.

The propane-oxygen mixture burning at a flame temperature of about 2,500° C. causes liquefaction or doughiness of the individual particles of the powdery nickel hard alloy, the expansion of the burning propane-oxygen mixture causing them to be discharged at high speed from a burner nozzle impinging them on the ironing side of the soleplate body portion. The soleplate body portion is thereby coated with the nickel hard alloy. The discharge speed of the burnt gas with the nickel particles contained therein is between 400 and 700 m/sec.

Such an arrangement is capable of processing about four kilograms of nickel hard alloy per hour. The quantity required for one soleplate being about 20 grams, about 200 soleplates per hour can be coated with this method.

The soleplate 3 provided on its ironing side with the coating 14 in this manner subsequently undergoes a grinding operation. Preferably, a drag grinding method is employed in which the soleplate 3 is periodically moved to and fro inside a container holding an abrasive substance comprised of a plurality of individual abrasive particles. In the process, the coating 14 is abraded down to a roughness average value according to German Standard DIN 4768 of $R_a=0.05$ to 2.0 μm, it being understood that the duration of the grinding operation is a function of the desired roughness.

To produce a surface with a coating 14 of especially good sliding abilities relatively quickly and thus particularly economically, the grinding operation is started in a first container holding abrasive particles which abrade the coating 14 down to a roughness average value according to German Standard DIN 4768 of $R_a=0.3$ to 0.7 μm, to be subsequently continued in a second container for polishing purposes, in which finer abrasive particles are contained which are capable of abrading the coating 14 down to a residual roughness average value of $R_a=0.05$ μm.

In detail, the grinding method used for the soleplate of the invention and known per se incorporates the following essential features and parameters:

An annular steel container coated with rubber on its inside is filled with abrasive particles to about 80% capacity. The soleplates to be processed are arranged on a superposed ring mount. The ring mount is caused to rotate, and the soleplates held in clamping fixtures are dragged through the bed of abrasive particles while turning about their own axis at the same time. The rotational speed of the ring mount is in the range of between 7 and 30 revolutions per minute, the grinding orbit having a diameter of about 1.5 m.

Where a pressure and a relative velocity are present between the abrasive particles and the smoothing iron soleplate, engagement of the cutting edges of the abrasive particles occurs, machining the soleplate. The flow of the abrasive particles follows the contour of the soleplate, so that also concave and convex surfaces are machined. The abrasive particle itself is a grain of aluminum oxide embedded in a plastic matrix with an average grain size of about 50 to 70 μm, being roughly shaped in the form of a tetrahedron with a side length of about 10 to 20 mm at the beginning of the grinding operation.

The abrasive particles used for the polishing operation are equally grains composed of aluminum oxide embedded in a plastic matrix and shaped in the form of a tetrahedron. The average grain size of the abrasive particle is in the range of about 20 to 40 μm, while its side length is in the range of about 10 mm at the beginning of the polishing operation.

Both the grinding and the polishing operation are preferably performed in the presence of water to which additives may be added. The additives are water-soluble substances available in solid, powdery or liquid state.

They serve the function of producing a clean surface on the coating which is free from any contaminants. Because of the thorough cleaning and wetting performed by the additives, the material abraded from the abrasive particles and the coating is continually removed from the surface to be machined, so that the abrasive particles retain their maximum grinding effect. The soleplates, the abrasive particles and the machinery used for the grinding and polishing operation are thus maintained in clean condition, bright and perfect surfaces are obtained, and a maximum grinding effect is ensured.

We claim:

1. A process for manufacturing a smoothing iron soleplate comprising the steps of providing a thermally conductive metallic soleplate body portion;

roughening the ironing side of said soleplate body portion by mechanical means to obtain a surface with a roughness average value in the range of about two-ten micrometers;

applying to said roughened surface of said soleplate body portion by thermal spraying a metal coating that is harder than said soleplate body portion; and subjecting the surface of said metal coating to a grinding operation to provide the coating surface with a roughness average value in the range of 0.05 to two micrometers, said grinding operation employing abrasive particles capable of abrading said coating down to a roughness average value in the range of 0.3 to 0.7 micrometers, and said grinding operation being followed by a polishing operation that employs finer abrasive particles capable of abrading said coating down to a residual roughness average value of about 0.05 micrometer.

2. The process of claim 1 wherein said grinding and polishing operations are performed in the presence of water.

3. The process of claim 1 wherein said metal coating is applied to said roughened surface of said soleplate body portion by means of high speed flame spraying with a flame temperature of about 2,500° C.

4. The process of claim 1 wherein said soleplate body portion is made of an aluminum alloy and manufactured by a die-casting method.

5. The process of claim 1 wherein said aluminum alloy has a composition selected from the group consisting of one of the alloys; GD-Al Si 10 Mg (9–11 percent silicon, 0.2–0.5 percent magnesium, 0.001–0.4 percent manganese. remainder aluminum), GD-Al Mg 9 (7–10 percent magnesium, 0.01–2.5 percent silicon, 0.2–0.5 percent manganese, remainder aluminum), GD-Al Si 12 (10.5–13.5 percent silicon, 0.001–0.4 percent manganese, remainder aluminum) and GD-Al Si 12(Cu) (10.5–13.5 percent silicon, 0.1–0.5 percent manganese, remainder aluminum) referred to in part 2 of the German Industrial Standard DIN 1725.

6. The process of claim 1 wherein said coating is a hard alloy, the main constituent of said hard alloy being selected from the group consisting of nickel, cobalt and chromium.

7. The process of claim 6 wherein said coating is a nickel alloy with a melting point of about 1,050° C. and a Rockwell hardness of up to about HRC 64.

8. The process of claim 7 wherein said coating is applied to the ironing side of said soleplate body portion by means of a high-speed flame spraying method with a comparatively low flame temperature in the range of about 2,500° C.

9. The process of claim 8 wherein said nickel alloy used in powder form for thermal spraying purposes and has a grain size in the range of about twenty to sixty micrometers.

10. The process of claim 1 wherein the thickness of said coating is between fifty and two hundred micrometers.

11. A process for manufacturing a smoothing iron soleplate comprising the steps of providing a thermally conductive metallic soleplate body portion; roughening the ironing side of said soleplate body portion by mechanical means to obtain a surface with a roughness average value in the range of about two-ten micrometers;

applying directly to said roughened surface of said soleplate body portion by thermal spraying a coating of a nickel alloy with a melting point of about 1050° C. and a Rockwell hardness up to about HRC 64; said nickel alloy being used in powder form with a grain size in the range of about twenty to about sixty micrometers, said nickel alloy being harder than said soleplate body portion; and subjecting the surface of said nickel alloy coating to a grinding operation to provide the coating surface with an average roughness value in the range of 0.05 to two micrometers, said grinding operation employing abrasive particles capable of abrading said coating down to a roughness average value in the range of 0.3 to 0.7 micrometers, and said grinding operation being followed by a polishing operation in a second container employing finer abrasive particles capable of abrading said coating down to a residual roughness average value of about 0.05 micrometer.

12. The process of claim 11 wherein said aluminum alloy includes about ten percent by mass of an alloying constituent selected from the group consisting of silicon and magnesium.

13. The process of claim 12 wherein said grinding and polishing operation are performed in the presence of water.

* * * * *